US006041980A

United States Patent [19]

Goodwin et al.

[11] Patent Number: 6,041,980

[45] Date of Patent: Mar. 28, 2000

[54] DOSING APPARATUS AND METHOD

[75] Inventors: James Goodwin; James Robert Stembridge, both of Coventry, United Kingdom

[73] Assignee: Lipton, Division of Conopco, Inc., Englewood Cliffs, N.J.

[21] Appl. No.: 08/967,616

[22] Filed: Nov. 11, 1997

[30] Foreign Application Priority Data

Nov. 11, 1996 [EP] European Pat. Off. ..... 96308141

[51] Int. Cl.[7] ..... B67D 3/00

[52] U.S. Cl. ..... 222/504

[58] Field of Search ..... 222/504; 53/551

[56] References Cited

U.S. PATENT DOCUMENTS

| | | | |
|---|---|---|---|
| 3,840,158 | 10/1974 | Baker et al. | 222/504 |
| 3,886,714 | 6/1975 | De La Poype | 53/551 |
| 5,277,344 | 1/1994 | Jenkins | 222/504 |
| 5,548,947 | 8/1996 | Finchman et al. | 53/551 |

FOREIGN PATENT DOCUMENTS

| | | |
|---|---|---|
| 197 575 | 3/1986 | European Pat. Off. . |
| 1439166 | 4/1966 | France . |
| 263 639 | 12/1926 | United Kingdom . |
| 1 459 690 | 12/1976 | United Kingdom . |
| 95/01907 | 1/1995 | WIPO . |

*Primary Examiner*—Philippe Derakshani
*Attorney, Agent, or Firm*—James J. Farrell

[57] ABSTRACT

A valve (16) reciprocates with a constant stroke in the former tube (2) of a form-fill apparatus to dispense doses of filling material from the tube by ejecting the material through an outlet nozzle (8). The size of the doses is adjustable, in one form of the invention, by feeding the material is fed through an adjustable dosing opening immediately adjacent the valve. In another form of the invention, the valve (16) is adjustably positionable relative to the former tube (2) to vary the mean position of reciprocation of the valve relative to the tube. In a further form of the invention, an adjustably controllable head of material is maintained in the former tube to determine the rate at which it is fed to the valve (16).

27 Claims, 4 Drawing Sheets

DOSING APPARATUS AND METHOD

BACKGROUND OF THE INVENTION

This invention relates to an apparatus and method for dispensing doses of particulate material.

SUMMARY OF THE PRIOR ART

In the production of packets by the form-fill process, a web of the packet material is shaped into a tubular form around a downwardly extending dosing tube as it is led down the tube, and is sealed transversely at intervals and separated at the transverse seals to form a series of sealed packets. Filling material is fed through the dosing tube into the tubular web in alternation with the formation of the transverse seals, so that each packet has a dose of filling material sealed within it as it is formed.

WO95/01907 (U.S. Pat. No. 5,548,947) describes such a process in which the filling material is dispensed from the dosing tube by a reciprocating plunger valve that expels the material in discrete doses into the tubular web. Such an arrangement is capable of operating at relatively high rates of packet production but control of the size of dose expelled by the valve requires regulation of the flow of material into the former tube. When the material is in the form of small particles, e.g. tea for tea bags, this has the disadvantage that close control of the doses is difficult, for example because of the tendency of the material to spread out as it falls through the former tube and because of the influence of random perturbations of the flow through the dosing tube.

SUMMARY OF THE INVENTION

According to one aspect of the invention, a dosing apparatus is provided for use in a form-fill process comprising a former tube through which filling material is supplied to a tubular envelope formed around the tube, means within the former tube defining a dosing opening for passage of the filling material, a dosing valve within the former tube being arranged to reciprocate to dispense discrete doses of the filling material from the former tube, and means being provided to vary the flow of the filling material through said dosing opening to control the quantity of material dispensed in each dose.

Apparatus according to the invention is preferably employed in a form-fill process in which the dosing valve is displaceable into an outlet opening at the outlet end of the former tube to expel each dose of the filling material therefrom. Preferably, it is arranged that the valve ends each dosing stroke closing the outlet opening so as to space the doses of material being dispensed therethrough.

In a preferred form of the invention, means within the former tube define a dosing opening the size of which is adjustable for said dosing control. Thus, an inner member can be provided which is located within the former tube adjacent to the dosing valve and is relatively displaceable to the former tube to adjust the size of said dosing opening.

If the inner member comprises a tubular element spaced from an internal wall of the former tube and defining said dosing opening therewith, it can be arranged that the tubular element forms a guide in which the dosing valve is reciprocable. The tubular element can thus extend coaxially with the dosing valve and with the former tube and may also form the outlet opening which is closed by the valve to terminate each dose.

The inner member may extend from the former tube remote from said dosing opening to an adjustment mechanism for displacement of the member in the former tube to obtain said variation of the size of the dosing opening.

In another aspect of the invention, there is provided a dosing apparatus for use in a form-fill process comprising a former tube through which filling material is supplied to a tubular envelope formed around the tube, a dosing opening defined within the former tube for passage of the filling material, a dosing valve within the former tube for reciprocation to dispense discrete doses of the filling material from the former tube, and means being provided to vary the flow of the filling material through said dosing opening to control the quantity of material dispensed in each dose.

According to a further aspect of the invention, a dosing apparatus provided for use in a form-fill process comprises a former tube through which filling material is supplied to a tubular envelope formed around the tube, a dosing valve within the former tube being arranged to reciprocate to dispense discrete doses of the filling material from the former tube, means being provided to vary the mean position of reciprocation of the valve relative to the tube to control the quantity of material dispensed in each dose.

In particular, if the dosing valve is displaceable into an outlet opening of the former tube to expel each dose, such adjustment of the valve mean position varies the stage in each stroke at which it enters the outlet opening and so terminates the feed of material into the opening. With this latter form of control, more generally it is not necessary to provide a specific dosing opening for the flow of material to the valve.

If an inner member defining a dosing opening is provided in the former tube of such an apparatus, it is similarly possible to exercise control of the dosing by causing the change of mean position of the valve to vary the stage at which the valve opens the dosing opening for delivery of the material therethrough. In such an arrangement, the inner member may remain fixed in position.

According to another aspect of the invention, a method of controlling dosing in a form-fill process is provided in which the material to be dosed is supplied to a a former tube around which a tubular packaging envelope is formed and is dispensed into said envelope by reciprocating valve means at an outlet from the former tube, a reservoir of the material being maintained in said tube upstream of the valve means and the rate of supply of the material to downstream of the valve means is controlled to vary the quantities of the doses of material dispensed by the valve means.

Said variation of the quantities of the doses of material dispensed can be achieved by maintaining a reservoir of the filling material within the former tube and allowing the material to pass from the reservoir to the valve means through a dosing opening the size of which can be adjusted. Alternatively, the mean position of reciprocation of the valve means relative to the outlet opening can be adjusted. In a further possibility, the head of material held in the reservoir within the tube is adjusted to vary the rate at which it can escape into the zone of action of the valve means. In each instance it is possible to vary the size of dose while maintaining the stroke of the valve means constant.

By way of example, the invention will be described in more detail with reference to the accompanying drawings, in which:

DESCRIPTION OF THE PREFERRED EMBODIMENTS

Figure 1:
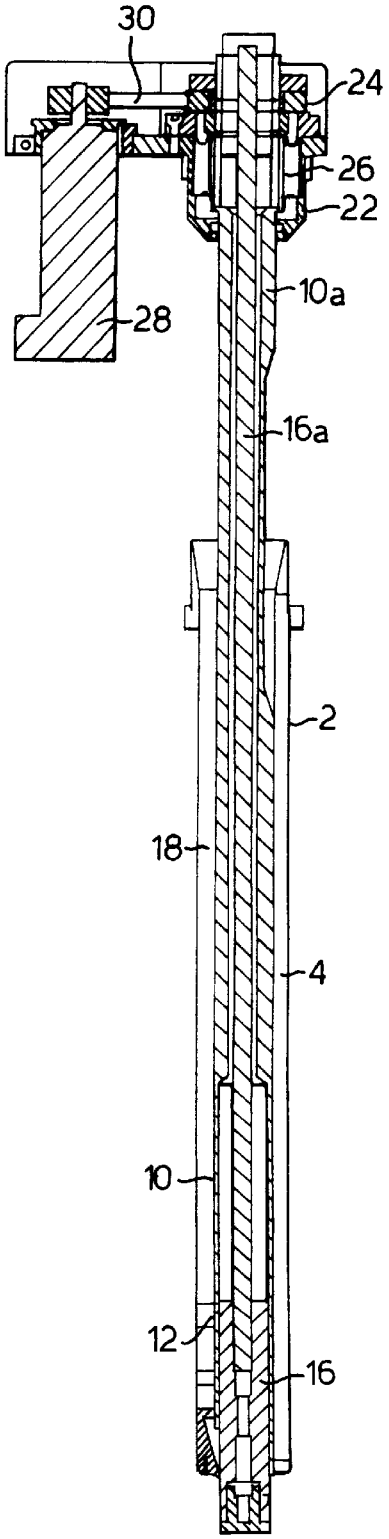
FIGS. 1 and 2 are axial sectional views of a former tube of a form-fill apparatus having a dosing apparatus according to the invention, a dosing valve of the apparatus being shown in the extended and retracted positions in FIGS. 1 and 2 respectively.

The form-fill apparatus in the drawing comprises a static outer tube 2 which acts as a former around which a descending web of heat-sealable packaging material is wrapped to overlap its side edges which are then welded together by heat sealing rollers while travelling down the tube. The web is thereby given a tubular shape in which, below the former tube, transverse welds are formed in known manner by a heat sealing arrangement to produce a series of welded compartments which can then be separated to form individual packets.

The filling material is dispensed from supply means (not shown) through the interior of the former tube 2 in a manner which allows it to be dispensed in discrete doses. Alternately with the formation of each transverse weld seal, a dose of material is delivered into the tubular web so that each compartment is filled before its upper end is sealed closed by a transverse weld.

As described so far, the process can operate as a conventional form-fill process. Reference can be made, for example, to WO95/01907 for further details of an apparatus in which such a process can be performed. The content of WO95/01907 is incorporated into the present application by reference, therefore, and only those features are illustrated and described that relate directly to the novel subject matter of the present invention.

Figure 3:
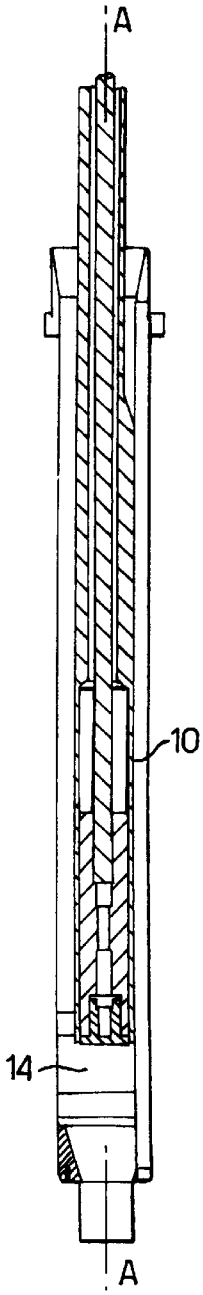
FIG. 3 is a similar view of the former tube showing a tubular dosing control element associated with the valve in an opposite end position to that which it occupies in FIGS. 1 and 2, FIGS. 4 and 5 are detail views of modifications of the apparatus in FIGS. 1 to 3, and FIGS. 6 to 9 illustrate some further modifications of the apparatus in accordance with the invention.

The interior of the tube is rotationally symmetrical about a central axis AA (FIG. 3), apart from the optional presence at one side of a small cross-section guide 4 containing a drive (not shown) for a spreader finger mechanism (which may be of the kind that is illustrated in WO95/01907). At its lower, exit end the tube has a concentrically tapered throat 6 leading into a cylindrical outlet nozzle 8 that is also concentric with the tube.

An inner tubular element or sheath 10 extends concentrically within the former tube 2 to near the outlet nozzle 8. The tubular element 10 has an extension 10*a* above the former tube to an adjustment mechanism (described below) by means of which it can be displaced progressively between a lowermost position shown in FIGS. 1 and 2 and an uppermost position shown in FIG. 3. To maintain the tubular element centralised within the former tube, radial fins 12, only one of which is shown projects inwards from the former tube into sliding contact with the tubular element. It will be noted that over its entire range of adjustment, the lower end of the tubular element 10 lies within the former tube 2, above the outlet nozzle 8. An essentially annular gap 14 is therefore always present between the former tube and the lower end of the tubular element and provides a dosing opening.

Figure 2:
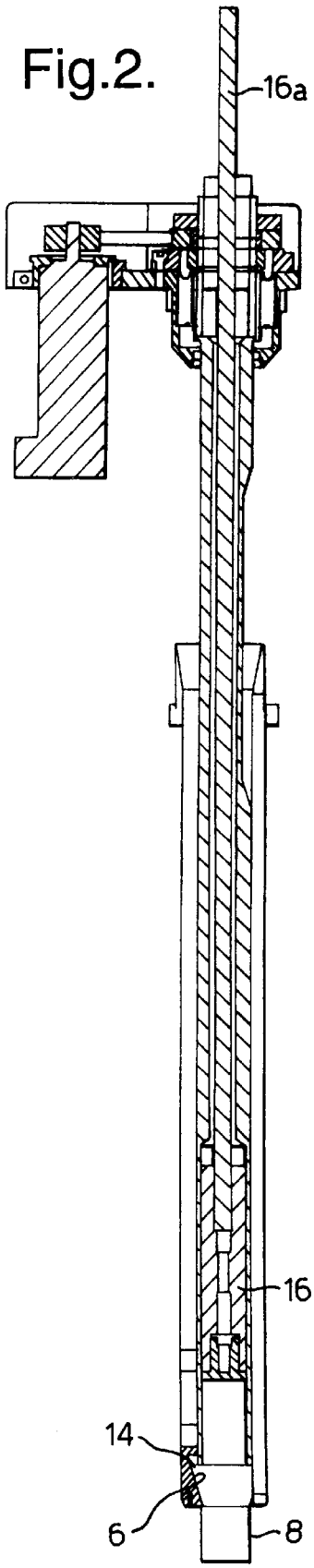

A dosing valve comprises a piston 16 concentric with the former tube is a free sliding fit within the tubular element and is axially displaceable between the positions shown in FIGS. 1 and 2 respectively. In the lower position the piston 16 extends into the outlet nozzle 8. In its upper position the piston is spaced above the tapered throat 6 of the former tube and is withdrawn wholly or mainly into the tubular element 10. The piston 16 is mounted on a central stem 16*a* that extends through the top of the tubular element 10 to a drive mechanism (not shown) to be reciprocated between the end positions illustrated, in order to expel a discrete dose of material from the nozzle on each down stroke.

The apparatus further comprises supply means (not shown) for dispensing material into the upper end of the former tube 2, in the annular free space 18 between the former tube and the tubular element 10. As the material falls to the bottom of the former tube 2, the piston 16 reciprocates to expel the material from the tube in the manner described in WO95/01907. The movement of the piston 16 is coordinated with the operation of the unillustrated heat sealing arrangement below the former tube so that the doses are dispensed in alternation to the formation of the transverse welds compartmenting the tubular web.

The upper extension 10*a* of the tubular element 10 is located in a guide mounting 22 above the former tube, in which it is held non-rotationally but is axially slidable. On top of the mounting a captive nut 24 is rotatably held, the internal thread of which engages an external thread on a sleeve 26 fixed to the extension 10*a*. A servo motor 28 is connected by a belt drive 30 to the captive nut 24 to rotate it, whereby the tubular element 10 is displaced axially. In this manner the tubular element is adjustable continuously between the end positions shown in the figures.

In operation, particulate filling material is supplied by the unillustrated supply means at a rate that will keep a reservoir of the material at least in the lower part of the annular space 18 between the former tube 2 and tubular element 10, to above the lower end of the tubular element, although it is preferred to maintain the former tube filled to the top. In its lowermost position shown in FIG. 1, the piston 16 blocks the annular gap 14 but as it is raised from the outlet nozzle 8 the material is allowed to escape through the annular gap 14 and the following down stroke of the piston then drives it into the tubular web. It will be understood that this arrangement is intended to operate at relatively high rates of reciprocation of the piston, so that there is little if any opportunity for the material to fall from the nozzle 8 under the action of gravity alone.

Because the material must first pass through the annular gap 14 between the former tube and the tubular element in order to escape below the piston to be expelled from the former tube, the size of that gap will determine the size of the dose. As the element is lowered from the position shown in FIG. 3, it narrows the gap 14 to increasingly restrict the path of the filling material, limiting the rate of flow. The position of adjustment of the tubular element can therefore determine the amount of material that will form the dose to be expelled by the piston.

In this manner, the dosing of the tubular web can be controlled independently of the drive of the piston, the speed and stroke of which can be kept constant. Furthermore, as this control is exercised immediately adjacent the former tube outlet, its effect is substantially instantaneous. The supply means feeding material into the former tube do not have to be regulated so closely as it is only required to ensure that they maintain a supply at a rate sufficient to keep a substantially constant head of material above the annular gap 14. The dosing of the compartments being formed in the tubular web can thus be controlled rapidly and easily, even at filling rates of more than 1000 doses per minute. The power requirement of the dosing control is minimal because only relatively small movements need to be made, at a rate far slower than the piston reciprocation rate.

Figure 4:
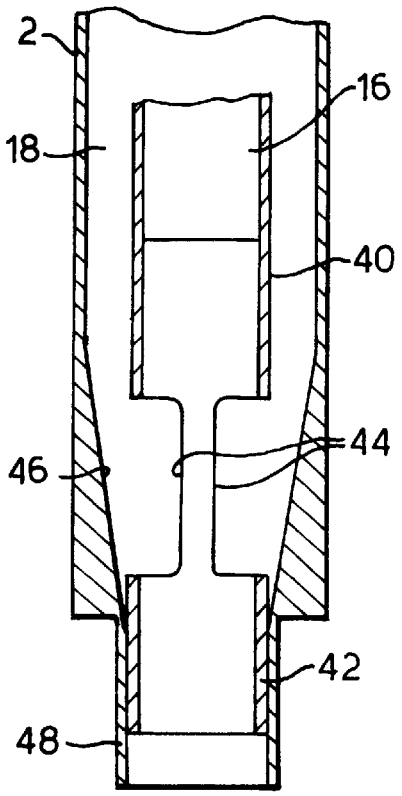
Figure 5:
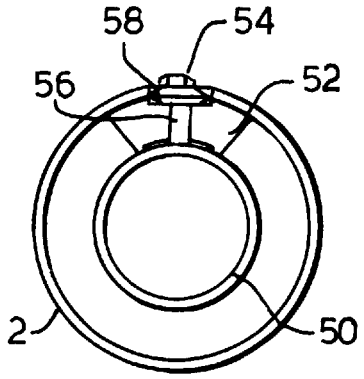

In order to keep the valve plunger aligned with the outlet nozzle, the lower end of the tubular element must also be held in alignment with the nozzle. FIGS. 4 and 5 show two alternative ways of doing this in place of the radial fins 12 of the example described above.

In FIG. 4, the tubular element 40 extends into the outlet nozzle 48 and its end portion 42 is a sliding fit in the nozzle 48. Large cut-outs 44 in the element above the end portion 42 form dosing openings and allow the filling material to escape from the reservoir of material in the annular space 18 to be expelled under the control of the valve piston 16 which operates in the manner already described, except that it now closes off the flow by entering the end portion 42 of the tubular element. In the same manner as the tubular element 10 already described, the tubular element 40 can be axially displaced, and the passage for the material is progressively restricted as the cut-outs 44 move downwards into tapered throat 46 and the outlet nozzle 48, so reducing the doses delivered by the dosing valve.

FIG. 5 shows a support for the tubular element 50 in the form of a segment 52 fixed to the wall of the former tube 2. Tie bolts 54 fixed to the tubular element 50 extend through elongate slots 56 in the support 52 and bear on the outer face of the support through spring washers 58. The tubular element 50 is thus resiliently clamped against the support but is able to slide axially in the former tube 2. In other respects the tubular element 50 can be identical to the tubular element 10 of FIGS. 1–3.

It is also possible to employ other means to vary the doses dispensed by the dosing valve while maintaining the stroke of the piston constant.

Figure 6:
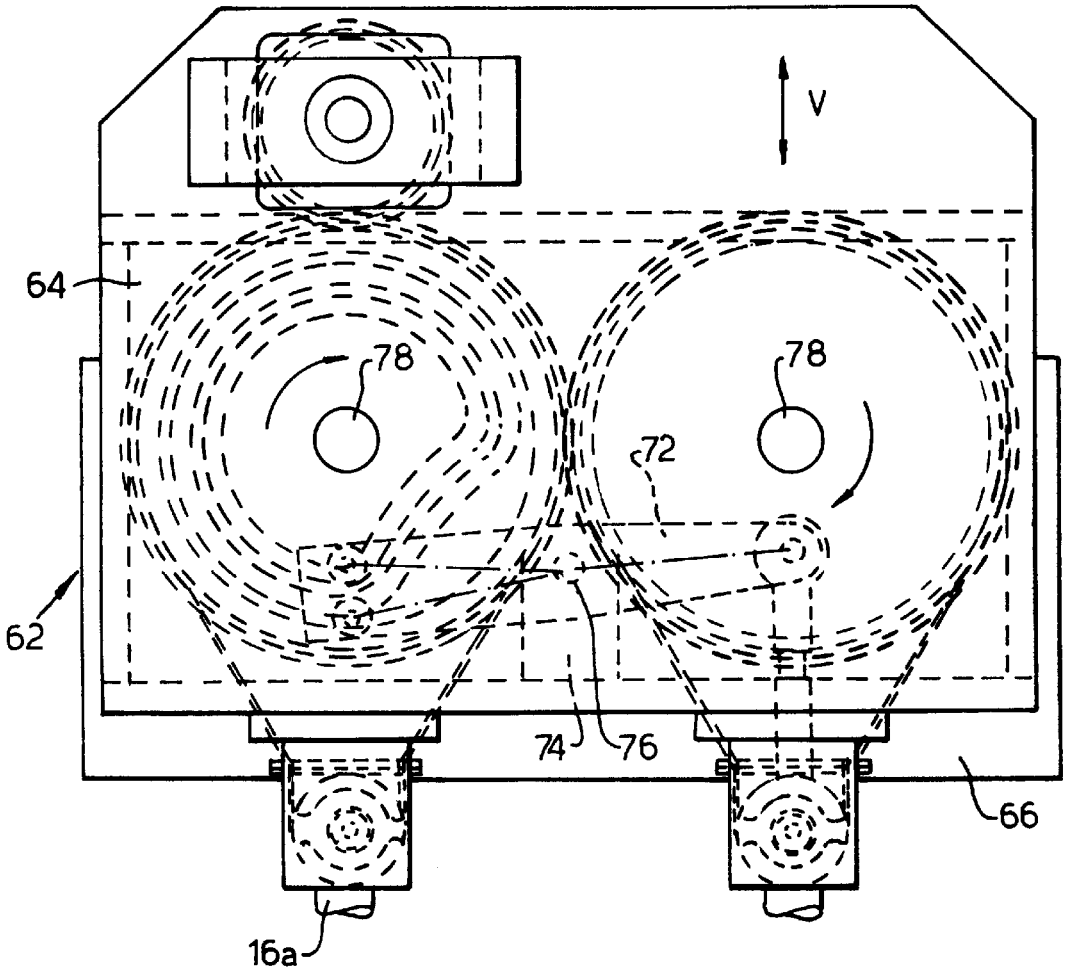

In the manner shown in WO95/01907, from which FIG. 6 is derived, the valve piston 16 is operated by a drive mechanism such as the cam drive mechanism 62 mounted in a frame 64 above the former tube 2. (As explained in U.S. Pat. No. 5,548,947, FIG. 6 shows a pair of counter-rotating drives, which balance out transverse forces, for identical, parallel production paths by the following description will be given with reference to only one of those paths). By mounting the frame 64 movably on support means 66, it can be displaced up and down, as indicated by the arrows V, relative to the former tube Z so that the mean position of the piston 16 in the former tube is varied, although the cam drive mechanism can continue to reciprocate the plunger valve with the same stroke. If, for instance, the mean position of reciprocation is lowered relative to the former tube 2, the outlet nozzle 8 is closed earlier in the downward stroke of the piston. It will be seen that the dose delivered from the reservoir of filling material maintained in the former tube is then reduced.

FIG. 6 also shows how the connection of the illustrated cam drive to the valve stem 18 is by a rocking lever 72 pivoted on a pillar 74 on the frame 64. A similar effect to that described in the preceding paragraph can be achieved by making the position of the pivot 76 adjustable on the frame upwardly and downwardly relative to the cam disc rotary mountings 78. The lever is thereby tilted in one direction or the other to change the mean position of reciprocation of the dosing valve upwards or downwards.

FIG. 6 shows two counter-rotating drive mechanisms 62 for two dispensing mechanisms arranged in parallel. With the first form of adjustment of the preceding paragraph both dispensing mechanisms are adjusted jointly. With this second form of adjustment, each may be adjusted independently.

Figure 7:
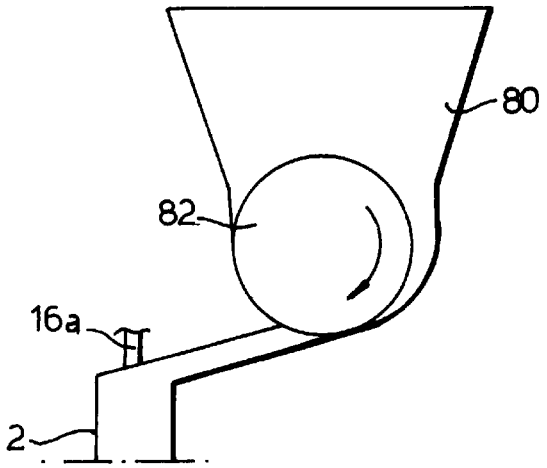

In another alternative, the mean position of the dosing valve in the former tube can be left unchanged and the dose varied by varying the height of the reservoir of material held in the former tube. For example, as shown schematically in FIG. 7 the filling material can be supplied from a hopper 80 at the outlet from which is a conventional dosing wheel 82 to control the supply of the material into the former tube 2. The rate at which the material is fed to the tube can be changed by varying the speed of the wheel 82, so building up the head of material in the reservoir or allowing it to fall to increase or decrease the dose size respectively.

In these alternative arrangements, it may not be required to have a discrete inner tubular element between the valve plunger and the former tube. The entry to the outlet nozzle then forms the dosing opening. However such a tubular element is preferably retained because it is found to contribute to uniformity of dosing. The tubular element may then be fixed or, where the mean position of the piston is adjustable, it may be adjustable with the piston so as to have a similar effect at all positions of adjustment.

In a further form of the invention the stroke of the piston is varied in order to control the dose size dispensed. In this example also the sleeve 10 is preferably retained because it contributes to the uniformity of dosing. The sleeve may be displaceable, although the dose size is now determined by the piston stroke, or it may be completely fixed. If fixed in place, it may assume a position such as that shown in FIG. 3, in which it will not throttle the flow when the piston is set to its maximum stroke. If movable, its displacement is preferably synchronised with the change of stroke of the piston by interlinking the mechanisms for these two adjustments.

Figure 8:
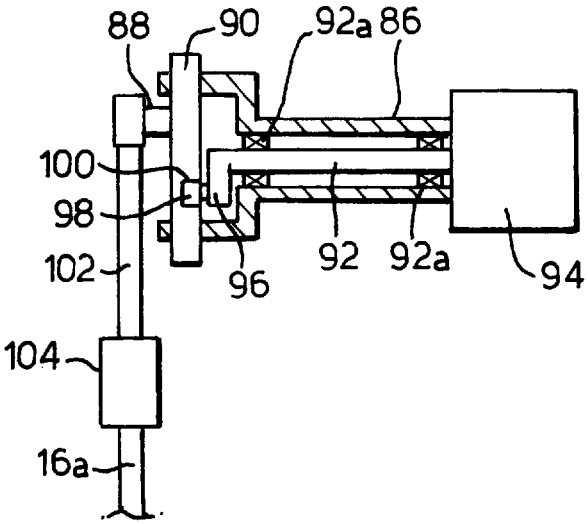
Figure 9:
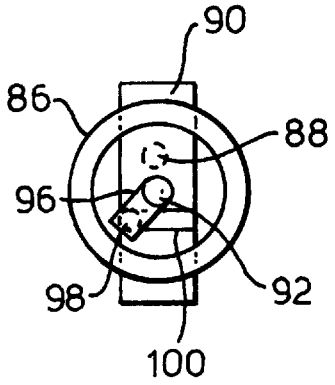

In one embodiment, shown in FIGS. 8 and 9, the piston is driven from a crank mechanism. Crank shaft 86 has crank pin 88 attached to it through a mounting bar 90 that is diametrically displaceable relative to the crank shaft axis. The crank shaft and a control shaft 92 extending through the craft shaft are rotated together by an input drive 94. The control shaft is mounted coaxially in the crank shaft on bearings **92*a* and the input drive 94 includes means for adjusting the relative angular positions of the crank shaft and control shaft. Such means for adjustment of a pair of co-rotating shafts are known in the art and are not illustrated in detail. The control shaft terminates in an arm 96 carrying an eccentric pin 98 that is located in a transverse slot 100 in the mounting bar. Rotational adjustment of the control shaft pivots the arm 96 and, through the pin and slot engagement, displaces the mounting bar 90 diametrically to the crank shaft. The radial offset of the crank pin 88 from the crank shaft axis is then altered. As a result, the throw of a connecting rod 102 journalled to the crank pin 88 is altered and the stroke of the piston is changed. FIG. 8 shows the connecting rod 102 connected to the piston stem 16*a* through a coupling 104 that ensures rectilinear motion of the valve stem 16*a***.

Figure 10:
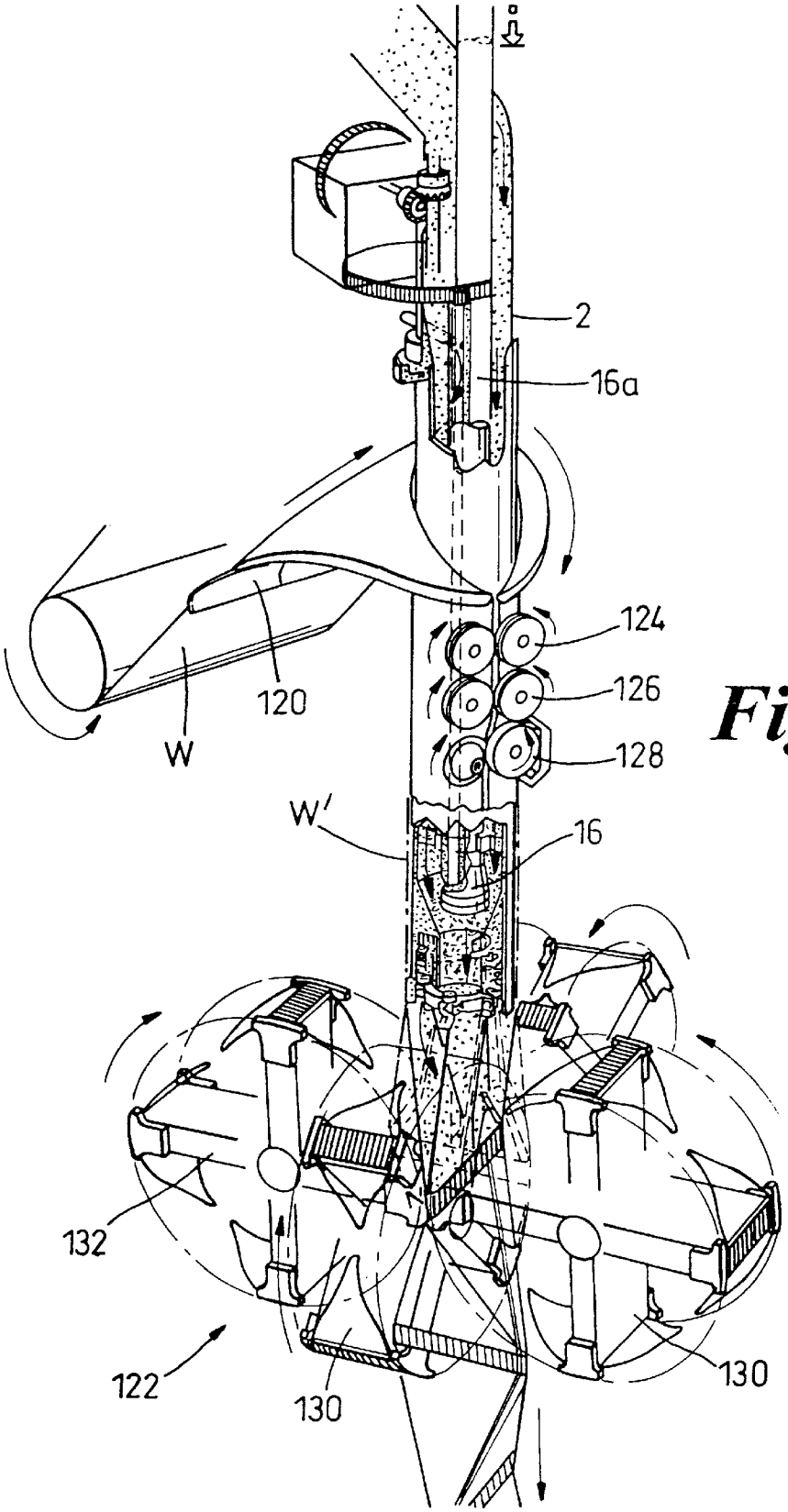
FIG. 10 is an oblique illustration of the form-fill apparatus in which the forms of dosing apparatus of the preceding figures can be incorporated.

FIG. 10 is a general view of the form-fill apparatus in which dosing apparatus as already described can be incorporated, although FIG. 10 shows only the dosing valve piston 16 and piston stem **16*a* of the dosing apparatus. The filler material is fed through a feeder tube to the tube 2. The web W of packaging material is drawn over a shaping guide 120 near the upper end of the former tube 4. Here the initially flat web W turns downwards from an upwardly inclined path to take up the tubular form of the former tube exterior, as indicated by the chain-like outline W', and is drawn down the tube while its opposite side edges are sealed together as it approaches the lower end of the tube. Immediately below the feed tube the web is first sealed transversely by sealing means 122** in synchronism with the delivery of the doses of particulate filling from the interior of the former tube to form individual packets containing doses of the material, and the chain of packets is then separated by a cutting operation.

The web is drawn down the outer face of the former tube 2 by pairs of rollers. These include pairs of heating and pressing rollers 124,126 between which the opposite edges of the web are sealed together longitudinally with a butt weld. The welded seam is then laid down against the tubular web by a roller and disc pair 128.

The transverse sealing means 122 for each path comprise two pairs of rotors 130, the axes of the two pairs of roters being at 90° to each other and to the web axis and the arms 132 of the rotors 130 interdigitating or interlacing to operate in alternation on the tubular web in order to produce tetrahedral-form packets. In the form illustrated, the apparatus has a corresponding arrangement of cutting rotors (not shown) below the sealing rotors. It is of course possible, however, to employ a single pair of rotors for compartmenting the web and a parallel pair of rotors for severing the compartmented packets to produce flat packets containing the filling material.

We claim:

1. A dosing apparatus for use in a form-fill process, comprising:

a former tube having an inlet end through which particulate filling material is supplied and a web of material being formed into a tubular envelope around the former tube, the former tube having an outlet end opposite said inlet end and a passage within the tube extending between said inlet and exit ends, a dosing opening in said passage through which said material passes, a dosing valve within the former tube co-operating with said dosing opening, a drive mechanism coupled to said valve for reciprocation of the valve to open and close said dosing opening alternately and dispense said material in discrete doses through said exit end into the tubular envelope, and means being provided to vary at least one of the rate of flow and the period for flow of the filling material through said dosing opening to control the quantity of material dispensed in each dose.

2. Apparatus according to claim 1 wherein the exit end of the former tube comprises an outlet nozzle and said reciprocation of the dosing valve displaces the valve into said outlet nozzle to expel each dose of the filling material therefrom.

3. Apparatus according to claim 1 comprising an adjustment mechanism for varying the size of the dosing opening for said control of the quantity of material dispensed in each dose.

4. Apparatus according to claim 1 comprising an adjustment mechanism connected to the dosing valve drive mechanism for displacing said drive mechanism relative to the former tube, whereby to vary the mean position of said reciprocation of the valve relative to the former tube for said control of the quantity of material dispensed in each dose.

5. Apparatus according to claim 1 comprising means for maintaining a reservoir of the filling material in the former tube above said dosing opening and for varying the height of said reservoir in order to control the quantity of material dispensed in each dose.

6. Apparatus according to claim 2 wherein the former tube passage has a tapered cross-section leading to said outlet nozzle.

7. Apparatus according to claim 2 wherein the dosing valve closes the tube exit end to terminate each dosing stroke.

8. Apparatus according to claim 3 wherein said dosing opening is located adjacent said exit end of the former tube.

9. Apparatus according to claim 3 wherein an inner member located within the former tube adjacent to the dosing valve is relatively displaceable to the former tube for the variation of the size of said dosing opening.

10. A dosing apparatus for use in a form-fill process, comprising:

a former tube having an inlet end to which filling material is supplied, the tube provide support for forming a web of material into a tubular envelope around the tube, the former tube defining a passage for the material supplied to the tube and having an exit end opposite said inlet end through which said material is delivered to the tubular envelope, a dosing opening in the tube passage intermediate said inlet and exit ends, a dosing valve within the former tube being arranged for reciprocation to dispense discrete doses of the filling material from the tube, a drive mechanism connected to said dosing valve and means for adjustment of said mechanism relative to the former tube for varying the mean position of said reciprocation of the valve relative to the dosing opening to control the quantity of material dispensed in each dose.

11. A dosing apparatus for use in a form-fill process with particulate filling material, comprising:

a former tube having an inlet end and an exit end opposite the inlet end, means for supplying the filling material to said tube inlet end and means for forming a flexible packaging web into a tubular envelope around the tube while progressing said web along the tube from the inlet end to the exit end, a dosing opening said tube exit for passage of the filling material supplied to the tube inlet, a tubular element located within the former tube and defining a dosing opening therein, passage being formed between the former tube and the tubular element for said filling material supplied to the inlet end to the dosing opening, a dosing valve within the former tube, the dosing valve extending through the tubular element and being displaceable to a position below said dosing opening for at least part of its reciprocating movement, and a drive mechanism connected to said valve for reciprocation of the valve to dispense discrete doses of the filling material through said exit end, and location adjustment means being provided for one of the valve drive mechanism and the tubular element relative to said tube exit end, whereby to control the quantity of material dispensed in each dose.

12. A dosing apparatus according to claim 11 wherein the drive mechanism for the valve comprises adjustment means for varying the length of reciprocating stroke of the valve in order to control the quantity of material dispensed in each dose.

13. A dosing apparatus according to claim 12 wherein the drive mechanism comprises means for varying a mean position of reciprocation of the valve in order to control the quantity of material dispensed in each dose.

14. A dosing apparatus according to claim 11 wherein an adjustment mechanism located externally of the former tube is connected to the tubular element to adjust its location relative to said tube in order to control the quantity of material dispensed in each dose.

15. A method of dosing control in a form-fill packaging method comprising the steps of:

(i) forming a packaging web around a downwardly extending former tube into a tubular envelope and progressing the web downwardly along the tube, (ii) supplying particulate material to an inlet at an upper end of said tube, a passage extending through the tube from said inlet to an exit at a lower end of the tube for dispensing the material into said tubular envelope, (iii) locating a dosing valve in said passage and reciprocating the valve to open and close the passage to dispense the material in discrete doses through said exit, (iv) maintaining said material in said tube passage to a level above said valve, and (v) adjusting one of the extent of the valve opening, the duration of the valve opening and the level of the material above the valve opening to regulate the amount of material dispensed in each said dose into the tubular envelope.

16. A dosing apparatus for use in a form-fill process, comprising:

a former tube having opposite inlet and outlet ends, said tube providing a former for shaping a web of packaging material into a tubular web around the former tube, said tube inlet end receiving a supply of particulate material to be deposited into said tubular envelope through said outlet end, a dosing valve within the former tube, a drive mechanism coupled to the dosing valve for reciprocation of the valve to dispense discrete doses of the filling material from the former tube, means forming a dosing opening within the former tube for controlling the quantity of material dispensed in each dose, said means comprising an inner member located within the former tube adjacent to the dosing valve and relatively displaceable to the former tube for adjustment said dosing opening to control the quantity of material dispensed.

17. Apparatus according to claim 16 wherein said inner member comprises an extension projecting externally of the former tube remote from said dosing opening, adjustment means being connected to the inner member extension for varying the size of the dosing opening.

18. Apparatus according to claim 16 wherein said inner member comprises a tubular element, an internal wall of the former tube being spaced from said element and defining said dosing opening therewith.

19. Apparatus according to claim 18 wherein the tubular element is displaceable axially of the former tube.

20. Apparatus according to claim 18 wherein the dosing valve is reciprocably displaceable into said tubular element.

21. Apparatus according to claim 16 wherein the former tube passage has a tapered cross-section leading to said outlet nozzle, and, in at least a part of the range of relative displacement between the inner member and the former tube, the dosing opening is defined between said tapered cross-section of the passage and the inner member.

22. A method according to claim 15 wherein the material is supplied to the valve through a dosing opening within the tube and the size of said opening is adjusted to vary said doses.

23. A method according to claim 22 in which a tubular element forms a boundary of said dosing opening and the valve is reciprocated between a retracted position in which it at least mainly withdrawn within said element and an extended position to which it moves to dispense a dose of material, the material path from the opening being blocked in said extended position.

24. A method according to claim 15 wherein the mean position of reciprocation of the valve relative to said tube is adjusted to vary said doses.

25. A method according to claim 15 wherein the level of said reservoir material within the tube is adjusted to vary said doses.

26. A dosing apparatus for use in a form-fill process comprising:

a former tube having opposite inlet and outlet ends, said tube providing a former for shaping a web of packaging material into a tubular web, said tube inlet end receiving a supply of particulate material to be deposited into said tubular envelope through said outlet end, a tubular element located within the former tube, a passage being defined between the former tube and the tubular element for the supply of filling material to the tube, a dosing opening forming an exit for the material from said passage, a dosing valve within the former tube for dispensing the material from the dosing opening, a drive mechanism for the dosing valve for reciprocating the valve to dispense the material in discrete doses from the former tube, said valve being displaceable to a position below said tubular element for at least part of its reciprocating movement, and the drive mechanism for the valve comprising means for varying the length of reciprocating stroke of the valve in order to control the quantity of material dispensed in each dose.

27. A method of dosing control in a form-fill packaging method comprising the steps of:

(i) forming a packaging web around a downwardly extending former tube into a tubular envelope and progressing the web downwardly along the tube, (ii) supplying particulate material to an inlet at an upper end of said tube a passage extending through the tube from said inlet to an exit at a lower end of the tube for dispensing the material into said tubular envelope, (iii) locating a tubular element within the former tube to form a boundary of a dosing opening in said passage intermediate said inlet and outlet, (iv) maintaining said material in said passage to a level above said dosing opening, (v) locating a dosing valve adjacent said dosing opening to control the flow of material through the dosing opening, (vi) dispensing said material from the former tube into said envelope in discrete doses by reciprocating said valve between a retracted position in which it is at least mainly withdrawn within said tubular element and an extended position to which it moves to dispense a dose of material, the material path between said opening and the tube exit being blocked in said extended position, and (vii) adjusting the size of the dosing opening to control the dose size.

* * * * *